United States Patent [19]

Weisbach et al.

[11] 4,132,403

[45] Jan. 2, 1979

[54] SHEET TRANSFER APPARATUS FOR PRINTING MACHINE

[75] Inventors: Günter Weisbach, Radebeul; Regina Wege, Leipzig, both of German Democratic Rep.

[73] Assignee: Veb Polygraph Leipzig Kombinat fuer Polygraphische Maschinen und Ausruestungen, Leipzig, German Democratic Rep.

[21] Appl. No.: 813,681

[22] Filed: Jul. 7, 1977

[51] Int. Cl.[2] ..... B65H 29/06; B65H 5/12

[52] U.S. Cl. ..... 271/277; 101/246; 271/82; 271/196

[58] Field of Search ..... 271/82, 196, 275, 276, 271/277, 10; 101/246

[56] References Cited

U.S. PATENT DOCUMENTS

| | | | |
|---|---|---|---|
| 2,794,637 | 6/1957 | Rugg | 271/82 X |
| 3,764,128 | 10/1973 | Bolza-Schunemann | 271/277 |
| 3,871,645 | 3/1975 | Buttner | 271/277 X |
| 4,050,574 | 9/1977 | Chenevard | 271/196 X |

*Primary Examiner*—Richard A. Schacher
*Attorney, Agent, or Firm*—Michael J. Striker

[57] ABSTRACT

Sheets are displaced from a supply to a continuously rotating receiver drum in a printing machine by means of a transfer drum having at least two angularly spaced grippers. The drum carrying the gripper is rotated at a relatively slow speed, and each of the grippers can be angularly displaced on the transfer drum and relative to the other gripper. Thus each gripper is accelerated after it picks up a sheet at the pickup station so that when it reaches a transfer station where it passes the sheet off to the receiver drum it is moving at the same speed as the receiver drum. Thereafter each gripper is uniformly decelerated so that when it has returned to the pickup station it is moving at the same speed as the sheet thereat.

10 Claims, 4 Drawing Figures

FIG. 1
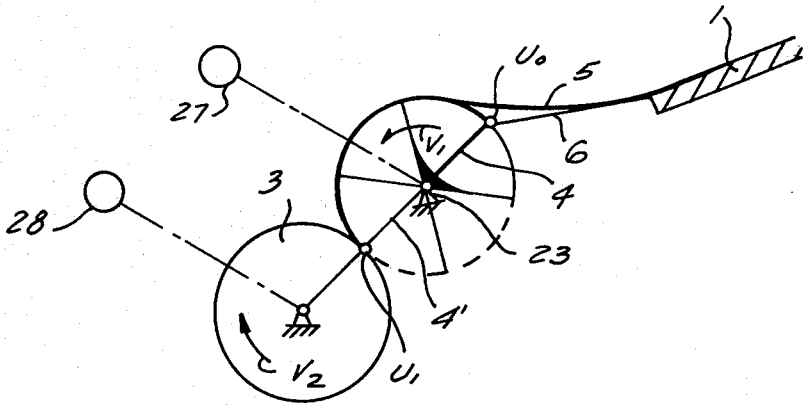
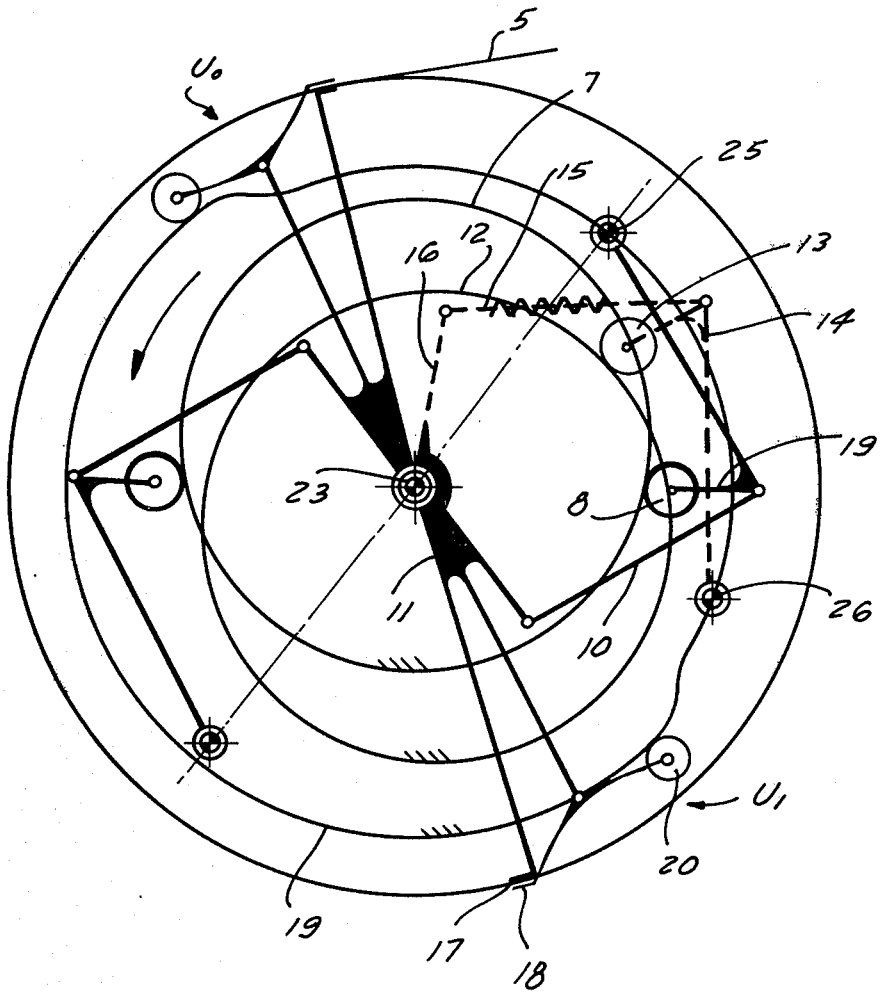
FIG. 3

FIG. 2
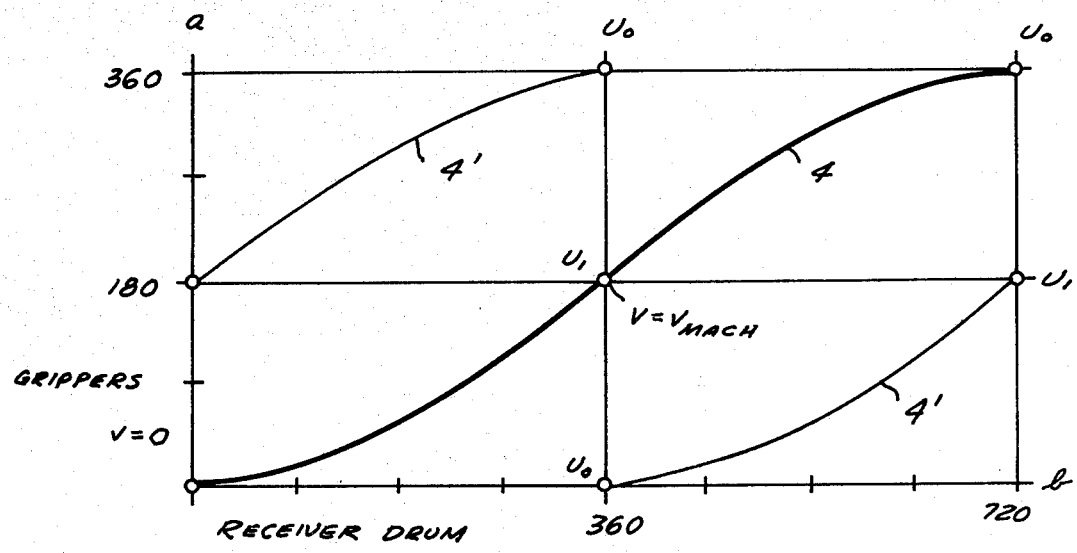
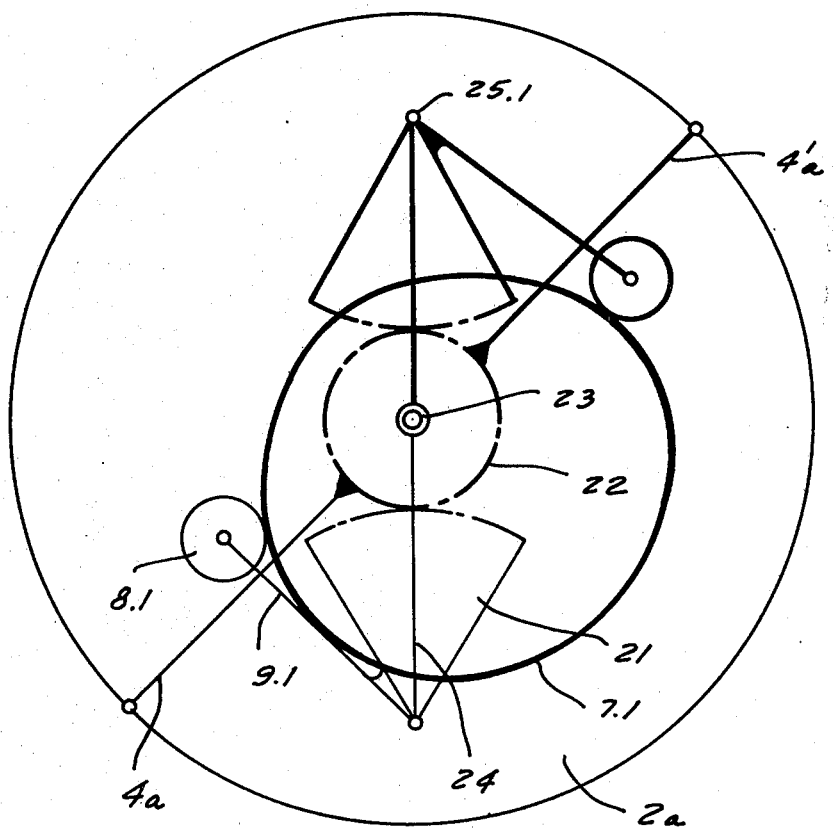
FIG. 4

SHEET TRANSFER APPARATUS FOR PRINTING MACHINE

BACKGROUND OF THE INVENTION

The present invention relates to a system for transferring sheets in a printing machine. More particularly this invention concerns a device for picking up sheets from a stack or the like and advancing these sheets to a continuously rotating receiver drum.

In order to feed a succession of sheets through a printing machine it is normally necessary to pick the sheets of a stack or otherwise displace them away from a supply location where they are either standing still or moving at a relatively low speed, to accelerate the sheets up to the peripheral speed of a first receiver drum, and to space the sheets apart in the direction of flow through the press by the desired distance. It is essential for good printing that the sheets pass in an orderly succession through the machine.

This is typically done, as shown in German Pat. No. 92,731 by means of a rotary transfer device which picks the sheets up from a pick-up station and passes them at a transfer station to the receiver drum or element of the printing machine. The receiver drum normally rotates as the same uniform speed and is provided on its outer surface with receiver grippers that grasp or otherwise engage the leading or trailing edge of a sheet fed to it at the transfer station. The transfer device, however, normally is provided with at least two angularly spaced grippers, which term is intended here to include a simple clamping arrangement, suction holders, and the like, and is rotated in steps, normally by a Maltese-cross arrangement. Thus the rotary transfer device comes to a complete halt or slows down very greatly as each of the grippers is aligned with the pick-up station so that the gripper can grasp the edge of a sheet, and then accelerates very rapidly so that by the time the gripper holding a sheet is aligned with the transfer station the sheet is moving at the same speed as the gripper of the receiver. When the two grippers of the transfer device are spaced apart by 180° the path between pick-up station and transfer station is normally slightly less than 180° so that immediately after a sheet is transferred from one gripper to the receiver the rotary transfer device can be arrested as the other gripper picks up the next sheet to be fed.

Such an arrangement therefore requires extremely rapid acceleration and deceleration of the transfer mechanism, resulting in extremely rapid wear of the mechanism thereof. Furthermore appropriate timing of the various devices in this arrangement becomes an extremely complex matter due to the very rapid acceleration and deceleration.

SUMMARY OF THE INVENTION

It is therefore an object of the present invention to provide an improved method of and apparatus for transferring sheets in a printing machine.

Another object is to provide an improved transfer system which overcomes the above-given disadvantages.

These objects are attained according to the present invention in a system wherein the two or more grippers on the rotary transfer device are independently angularly displaceable. Means is provided for uniformly accelerating each gripper as it moves from the pick-up station to the transfer station and for thereafter uniformly decelerating it. There is no relative velocity between each gripper and the receiver at the transfer station and between each gripper and the sheet at the pick-up station. Thus each gripper is accelerated to the same speed as the receiver gripper at the transfer station and at the pick-up station each gripper is either moving at the very slow speed of the sheets at the pick-up station or is momentarily stopped as a sheet is picked up.

Thus with the system according to the present invention the entire stroke or revolution of the rotary transfer device is employed for the sinusoidal acceleration and deceleration of the grippers thereof. In this manner the amount of throw and wear inherent in the system is reduced by a factor of at least two, as in the prior-art systems both grippers were normally accelerated and decelerated twice during each single revolution of the rotary transfer device, as the grippers were not independently angularly displaceable relative to each other.

According to further features of this invention the means for accelerating and decelerating the two grippers includes a cam for each gripper, a cam follower, and a linkage between each cam follower and the respective gripper. The grippers can be pivotal about the axis of the rotary unit carrying them or can be pivotal about respective axes offset on the unit from the rotation axis of the unit. A link extending between each of the cam followers and the respective pivotal support for each gripper effects the necessary acceleration and deceleration of the gripper.

According to this invention the sheets are either fed very slowly to the pick-up station one after the other, or are stationary at the pick-up station so that the grippers must each be brought virtually to a halt at the pick-up station. To this end the rotary unit carrying the grippers is normally rotated so that its peripheral speed is approximately midway between the maximum and minimum speeds to be attained by each of the grippers.

The grippers in accordance with this invention may be of the standard clamping type having a pair of relatively displaceable pinching elements, or may be of the suction or vacuum type which merely hold the sheets in place by differences in gas pressure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is an end largely diagrammatic view of the arrangement according to this invention;

FIG. 2 is a graph illustrating operation of the system according to this invention; and FIGS. 3 and 4 are large-scale partly diagrammatic views illustrating apparatuses according to this invention.

DESCRIPTION OF THE PREFERRED EMBODIMENTS

As shown in FIG. 1 a printing machine has a supply or support table 1 provided adjacent a transfer unit or drum 2 that is rotatable on an axle 23 adjacent a receiver drum 3 having the same diameter but rotating in the opposite direction. Drives 27 and 28 are provided for the drums 2 and 3. The supply table 1 carries sheets 5 and 6 to a pick-up station or location U0 and the drum 3 oscillates the drum 2 at a transfer station U1. The transfer drum 2 is provided with two diametrically offset grippers 4 and 4'.

As also shown in FIG. 2 the drum 2 is rotated at a peripheral speed V1 which is equal to half of the peripheral speed V2 of the drum 3. The lines on the graph of FIG. 2 illustrate the relative positions of the grippers 4 and 4', the gripper 4 being shown in a heavy line and the grippers 4' in a relatively light line. The slope of these lines illustrates their velocities. The angular displacement a of the grippers 4 and 4' being shown in the ordinate and the angular displacement b of the drum 3 being shown on the abcissa.

In the arrangement shown in FIG. 3 each of the grippers 4 and 4' is shown to be associated with a respective cam 7. The linkages and cam arrangements for the two grippers 4 and 4' are identical so that hereinafter only that of gripper 4 will be described.

The cam 7 is of cylindrical or circular shape and is offset from the axle 23. A cam follower 8 carried on one end of an arm of a two-arm lever 9 rides on the cam 7. The other arm of the lever is secured at 25 to the respective drum 2 so as to move rotationally therewith. The fulcrum of the lever 9 is secured to one end of link 10 whose other end is secured to a support or mounting arrangement 11 for the gripper 4 at a location radially offset from the axle 23 about which the support 11 is pivotal. Another cam 12, follower 13, lever 14 and link 15 are provided connected to an arm 16 of the support 11. These parts 12, 13, 14 and 15 correspond roughly to the parts 7, 8, 9 and 10 and serve to properly position the gripper 4 by acting against the other linkage 8–10. To this end the link 15 is spring loaded and the cam 12 is radially offset in the opposite direction from the cam 7 relative to the axle 23.

The gripper 4 includes an anvil 17 fixed on the support 11 and a displaceable element 18 operated by a cam follower 20 riding on a gripper cam 19. Thus the gripper 4 closes at the station U0 and opens at the station U1.

The apparatus described above functions as follows:

As each gripper 4 and 4' is displaced past the station U0 its respective cam 7' moves it backwardly on the rotary unit 2 so that it virtually comes to a halt or at least moves at a relatively slow speed that is identical to the displacement speed of the leading sheet 5.

At this instant then the gripper 4 closes on the leading edge of the sheet 5 under the action of the cam 19. The cam 7 is then effective uniformly to accelerate the gripper 4 and the sheet 5 it is holding until it is moving at a peripheral speed which is substantially greater than the peripheral speed of the unit and which is equal to the peripheral speed V2 of the receiver drum 3.

As the clamp 4 moves into the station U1 it is opened by the cam 19 and the sheet 5 is passed to the drum 3. Meanwhile the other clamp 4' has moved into the station U0 and has been slowed down to grip the leading edge of the next sheet 6, whereupon the above-described operation is carried out for the sheet 6.

As soon as the gripper 4 has released the sheet 5 it is decelerated by the cam 7 until it is moving at the requisite slow speed or is stopped to pick up yet another sheet.

The arrangement of FIG. 4 has a drum 2*a* similar to the drum 2 but provided with two suction-type grippers 4*a* and 4*a*'. These two grippers 4*a* and 4*a*' are mounted on respective gears 22 only one of which is shown. Cam followers 8.1 coact with a single cam 7.1 and are connected to arms 9.1 pivoted on respective pivots 25.1 centered on the axle 23. Each of these levers 9.1 is connected via a respective link 24 to the axle 23 and carries a sector 21 meshing with the respective gear 22. The two gears 22 are independently rotatable about the axle 23.

The arrangement of FIG. 4 operates in the same manner as the arrangement of FIG. 3. Here, however, the acceleration and deceleration of the suction grippers 4*a* and 4*a*' is effected by means of the gear linkage and the operative meshing engagement of the sectors 21 with the gears 22 that are rotationally fixed to the grippers 4*a* and 4*a*'.

It will be understood that each of the elements described above, or two or more together, may also find a useful application in other types of machines, differing from the types described above.

While the invention has been illustrated and described as embodied in a transfer apparatus, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that from the standpoint of prior art fairly constitute essential characteristics of the generic or specific aspects of this invention.

What is claimed as new and desired to be protected by Letters Patent is set forth in the appended claims:

1. A sheet transfer apparatus for a printing machine, said apparatus comprising:
   - a pickup station adapted to have a supply of sheets;
   - a transfer unit rotatable about an axis adjacent said pickup station;
   - a receiver defining a transfer station adjacent said unit and angularly offset from said pickup station;
   - means for displacing said receiver at said transfer station at a predetermined receiver velocity;
   - two grippers spaced angularly apart and independently angularly displaceable on said transfer unit, each gripper including means for picking up a sheet at said pickup station and releasing the picked-up sheet at said transfer station;
   - means for rotating said unit about said axis at constant angular velocity and for thereby orbiting said grippers past said stations;
   - means for accelerating each of said grippers relative to said transfer unit and independently of the other gripper as the respective gripper passes from said pickup station to said transfer station, from a displacement rate at which there is no relative movement between the gripper and a sheet located at said pickup station to a displacement rate which is generally equal to said receiver velocity; and
   - means for decelerating each of said grippers relative to said transfer unit and independently of the other gripper as the respective gripper passes from said transfer station to said pickup station, from a displacement rate which is generally equal to said receiver velocity to a displacement rate at which there is no relative movement between the gripper and a sheet located at said pickup station.

2. The apparatus defined in claim 1, wherein said means for accelerating and decelerating includes two cams and two linkages between said cams and said grippers.

3. The apparatus defined in claim 2, wherein said linkages each include a cam follower and a link between the respective cam and the respective gripper.

4. The apparatus defined in claim 1, wherein said grippers are of the clamping type and each have a pair of pinching elements.

5. The apparatus defined in claim 1, wherein said grippers are of the vacuum or suction type.

6. The apparatus defined in claim 1, wherein said grippers are independently angularly displaceable about said axis.

7. The apparatus defined in claim 1, wherein said grippers are independently angularly displaceable about respective axes fixed in said unit and offset from said axis thereof.

8. An apparatus for transferring sheets in a printing machine, said apparatus comprising:

a pickup station having a supply of sheets;

a transfer unit rotatable about an axis adjacent said pickup station;

a receiver defining a transfer station adjacent said unit and angularly offset from said pickup station;

means for displacing said receiver at said transfer station at a predetermined receiver velocity;

two grippers spaced angularly apart and independently angularly displaceable on said transfer unit, each gripper including means for picking up a sheet at said pickup station and releasing the picked-up sheet at said transfer station;

means for rotating said unit about said axis and thereby orbiting said grippers past said stations;

means for accelerating each of said grippers as same passes from said pickup station to said transfer station independently of the other gripper from a displacement rate with no relative movement between the gripper and a sheet at said pickup station to a displacement rate generally equal to said receiver velocity; and means for decelerating each of said grippers as same passes from said transfer station to said pickup station independently of the other gripper from a displacement rate generally equal to said receiver velocity to a displacement rate with no relative movement between the gripper and a sheet at said pickup station, said means for accelerating and decelerating comprising two cams and two linkages between said cams and said grippers, each of said linkages including a toothed element in meshing operative engagement with the respective gripper.

9. A method of transferring sheets in a printing machine, comprising the steps of orbiting two angularly spaced grippers about a gripper axis which rotates at constant velocity past a pickup station and past a transfer station which is angularly spaced relative to said axis from said pickup station;

holding a succession of sheets at said pickup station;

displacing a receiver at a predetermined receiver velocity periodically past said transfer station;

grasping an edge of a sheet at said pickup station with each gripper each time the same passes said pickup station, displacing the grasped sheet with the respective gripper to said transfer station, and thereupon releasing the grasped sheet from the gripper as the same passes said transfer station;

accelerating each of said grippers, as the same moves from said pickup station to said transfer station, independently of the other gripper and beyond said constant velocity to a maximum velocity at said transfer station which is generally equal to said receiver velocity; and decelerating each of said grippers, as the same moves from said transfer station to said pickup station, from said maximum velocity to a displacement rate at which there is substantially no relative movement between the gripper and a sheet at said pickup station.

10. The method defined in claim 9, wherein said grippers are temporarily substantially stopped as they pass said pickup station.

* * * * *